US011123243B2

(12) United States Patent
Wada et al.

(10) Patent No.: US 11,123,243 B2
(45) Date of Patent: Sep. 21, 2021

(54) MOBILE OBJECT

(71) Applicant: SUZUKI MOTOR CORPORATION, Hamamatsu (JP)

(72) Inventors: Masayoshi Wada, Hamamatsu (JP); Gopinath Raja, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 119 days.

(21) Appl. No.: 16/593,399

(22) Filed: Oct. 4, 2019

(65) Prior Publication Data

US 2020/0246204 A1 Aug. 6, 2020

(30) Foreign Application Priority Data

Jan. 31, 2019 (JP) ..... JP2019-015892

(51) Int. Cl.
*A61G 5/12* (2006.01)
*A61G 5/08* (2006.01)

(52) U.S. Cl.
CPC ..... *A61G 5/08* (2013.01); *A61G 5/125* (2016.11)

(58) Field of Classification Search
CPC ..... A63C 11/222; B60N 2/753; A47C 7/543; A61G 5/14; A61G 5/125; A61G 5/0833; A61G 5/0866
See application file for complete search history.

(56) References Cited

U.S. PATENT DOCUMENTS 3,612,606 A * 10/1971 Swenson ..... A47C 7/543 297/411.31
4,040,665 A * 8/1977 Wallace ..... B60N 2/753 297/411.32
4,159,145 A * 6/1979 Quakenbush ..... A47C 7/543 297/113

(Continued)

FOREIGN PATENT DOCUMENTS

JP H 10-248879 9/1998
JP 2000-005239 1/2000

(Continued)

OTHER PUBLICATIONS

Suzuki exhibits the concept model "kupo" at "2020, Shibuya. Let's experience the daily life of super welfare", Development of a walking assistance vehicle with the function of an electric wheelchair. URL: https://www.suzuki.co.jp/release/c/2018/1102/, Nov. 2, 2018, Publisher: Suzuki Motor Corporation.

*Primary Examiner* — Emma K Frick
(74) *Attorney, Agent, or Firm* — Cozen O'Connor

(57) ABSTRACT

A mobile object of the invention includes: a moving base including a front wheel and a rear wheel; a seat having a seating surface; and an armrest located outward of the seating surface in a width direction of the mobile object. The armrest includes: a supporting part supported on the moving base; a body part supported by the supporting part; and a grip protruding from the body part. The armrest is configured so as to be changeable between the position of use in which a user seated on the seating surface can hold the grip with the arm positioned upward of the armrest, and the lift-up position in which the grip is positioned upward of the position of use. The grip in the lift-up position is located outward in the width direction of the mobile object with respect to the grip in the position of use.

4 Claims, 4 Drawing Sheets

(56) References Cited

U.S. PATENT DOCUMENTS 4,270,798 A * 6/1981 Harder, Jr. ..... A47C 7/543 297/411.31
5,356,172 A * 10/1994 Levy ..... A61G 5/00 180/907
5,542,690 A * 8/1996 Kozicki ..... A61G 5/045 180/907
6,176,508 B1 * 1/2001 Malassigne ..... A61G 5/1002 280/648
6,471,297 B1 * 10/2002 Runde ..... B60N 2/753 297/411.32
6,739,669 B2 * 5/2004 Etzioni ..... A47C 7/543 297/378.1
7,125,080 B1 * 10/2006 Jarema, III ..... B60N 2/3011 297/411.32
7,438,318 B2 * 10/2008 Sano ..... B66F 9/07545 280/756
7,537,069 B2 * 5/2009 Kramer ..... A47C 7/62 180/21
7,677,654 B2 * 3/2010 Enberg ..... B60N 2/77 297/115
7,731,290 B1 * 6/2010 Kurimoto ..... B60N 2/753 297/411.32
8,919,797 B2 * 12/2014 Lowenthal ..... A61G 5/04 280/250.1
9,427,364 B2 * 8/2016 Grant ..... A61G 5/125
2004/0085295 A1 * 5/2004 Cowen ..... A61G 5/04 345/161
2006/0255642 A1 * 11/2006 Epaud ..... B60N 2/757 297/411.38
2015/0175227 A1 * 6/2015 Chang ..... A61G 5/045 180/22
2020/0016015 A1 * 1/2020 Van De Kieft ..... A61G 5/046
2020/0268577 A1 * 8/2020 Lau ..... G05D 1/0212
2020/0315876 A1 * 10/2020 Raja ..... A61G 5/041
2020/0315880 A1 * 10/2020 Raja ..... A61G 5/0833

FOREIGN PATENT DOCUMENTS

JP 2001-048497 2/2001
JP 2005-328914 12/2005
JP 2006-103512 4/2006
JP 2009-183407 8/2009
JP 2016-168153 9/2016

* cited by examiner

MOBILE OBJECT

FIELD OF THE INVENTION

The present invention relates to a mobile object including a moving base having a front wheel and a rear wheel, a seat provided on the moving base, and an armrest located on a lateral side of the seat.

BACKGROUND OF THE INVENTION

In related art, mobile objects, such as wheelchairs, carts, or the like are used as moving means for users, such as elderly persons, persons needing care, or the like. Typically, the mobile object includes a moving base having front wheels and rear wheels and a seat provided on the moving base, so that the user is capable of moving in a state of being seated on the seat. As mobile objects, electric vehicles, such as electric wheelchairs, electric carts, or the like which are capable of self-traveling by means of driving means, such as a motor or the like are widely used. The electric vehicle is also referred to as a "senior car".

The mobile object further includes an armrest which allows the user seated on the seat, to place an arm. In an example of such a mobile object to be presented, the mobile object includes an electric vehicle including a seat having a seat cushion and a seat back, and armrests supported so as to be pivotable about supporting points on both sides of the seat back, in which the armrest is configured so as to be rotatable between a front position in which the armrest is positioned along the front-rear direction of the seat, and a flipped-up position in which the armrest is flipped in the upper-lower direction from the front position. (for example, see JP 2006-103512 A)

BRIEF SUMMARY OF THE INVENTION

In the example of the mobile object described above, the armrest is simply placed along the front-rear direction of the seat in a position of use, so that a space over the entire width direction of the seat is formed in front of the user seated on the seat. Therefore, the user is less likely to feel the sense of stability of being seated, in particular, when the mobile object travels.

In the example of the mobile object described above, the user may often move the armrest from the front position to the flipped-up position before getting off the mobile object. At this time, the armrest pivots toward the user along a plane extending in the front-rear direction and the upper-lower direction of the seat. Therefore, the armrest may become an obstacle for the user, in particular, for a user about to dismount the mobile object.

In the example of the mobile object described above, the armrest protrudes outward in the width direction of the seat in the position of use. Therefore, the armrest is a factor increasing the width of the mobile object. In view of a condition that the mobile object needs to travel in a narrow space, it is also important to configure the armrest so as to help to reduce the size of the mobile object.

In the example of the mobile object described above, the mobile object may move in a state in which baggage, such as a shopping basket, and luggage is placed on the seat. However, since the space spreading over the entire width direction of the seat is formed, the baggage is less likely to be supported stably on the mobile object. Therefore, there is room for improvement of convenience of the mobile object taking the placement of baggage or the like into consideration.

In view of the above circumstances, it is desirable to configure the mobile object so as to be capable of improving a sense of stability in seating for a user, capable of preventing the armrest from becoming an obstacle for the user, capable of reducing the size of the mobile object, and capable of improving convenience of the mobile object.

To solve the above-described problems, a mobile object according to an aspect is a mobile object including: a moving base including a front wheel and a rear wheel positioned at a distance from each other in a front-rear direction of the mobile object; a seat having a seating surface and disposed on the moving base; and an armrest located outward of the seating surface in a width direction of the mobile object, the armrest including a supporting part configured so as to be supported on the moving base and a body part configured so as to be supported by the supporting part, the armrest further includes a grip protruding from the body part, the armrest is configured so as to be changeable between a position of use where the armrest is positioned so as to allow the user seated on the seating surface to hold the grip with an arm of the user positioned above the armrest and a lift-up position where the grip is positioned so as to be lifted upward of the position of use, the grip at the lift-up position being located outward of the grip in the position of use in the width direction of the mobile object.

The mobile object according to one aspect is capable of improving the sense of stability in seating for the user, capable of preventing the armrest from becoming obstacles for the user, capable of reducing in size of the mobile object, and capable of improving convenience of the mobile object.

DETAILED DESCRIPTION OF THE INVENTION

In the present Embodiment, an electric vehicle configured as a mobile object, will be described below. In this specification, the mobile object may have a single seat, and in addition, the mobile object is configured so as to open the seat to the outside of a seat provided thereon. For example, the mobile object may be a wheelchair, a cart, and/or the like and in particular, the mobile object may be single-seater wheelchair, a single-seater cart, and/or the like. However, the mobile object is not limited to these configurations.

The electric vehicle according to the present Embodiment is configured so as to be capable of traveling by electromotive drive. In the present Embodiment, the electric vehicle is an electric cart, and in particular, is a single-seater electric cart. However, the electric vehicle is not limited to this, and it may be a vehicle other than the electric cart. For example, the electric vehicle can be an electric wheelchair, and in particular, can be a single-seater electric wheelchair. Hereinafter, the electric vehicle is simply called a "vehicle", if necessary.

Figure 1:
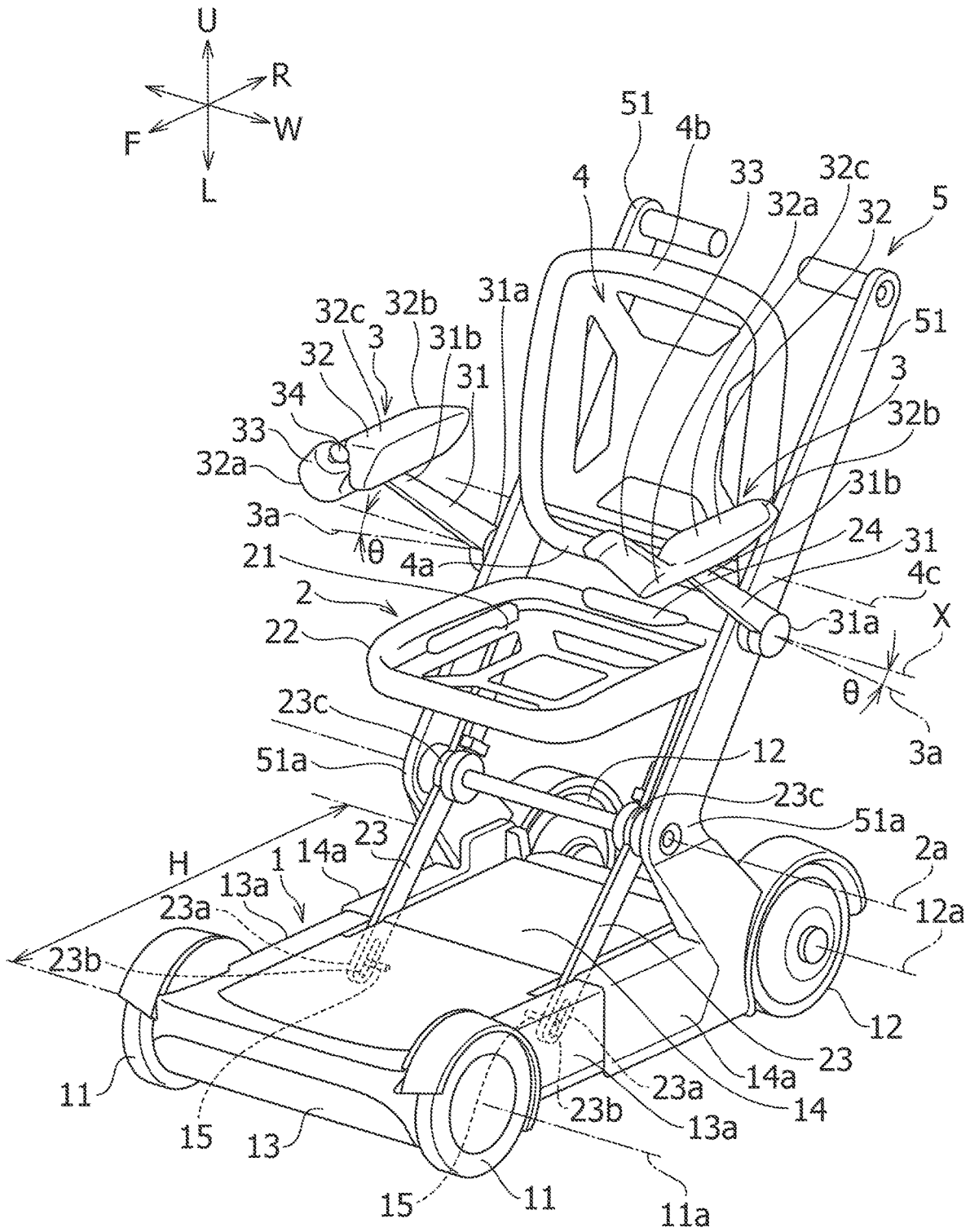
FIG. 1 is a front perspective view schematically showing an electric vehicle according to the present Embodiment with a moving base in an expanded state, a seat in a seating position, an armrest being at a position of use, and a back plate in a standing-up position.
Figure 2:
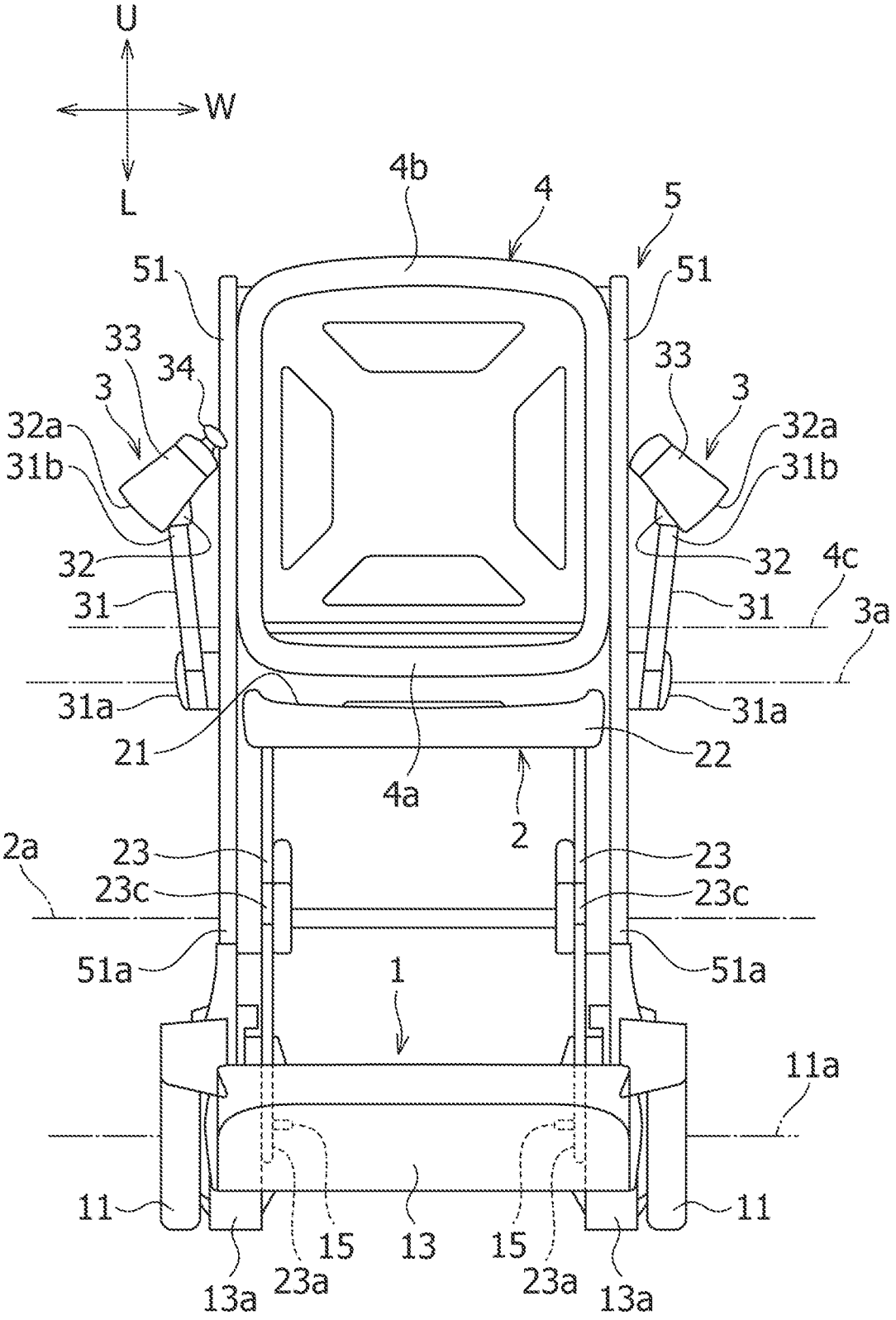
FIG. 2 is a front view schematically showing the electric vehicle according to the present Embodiment with the moving base in the expanded state, the seat in the seating position, the armrest being at the position of use, and the back plate at the standing-up position.
Figure 3:
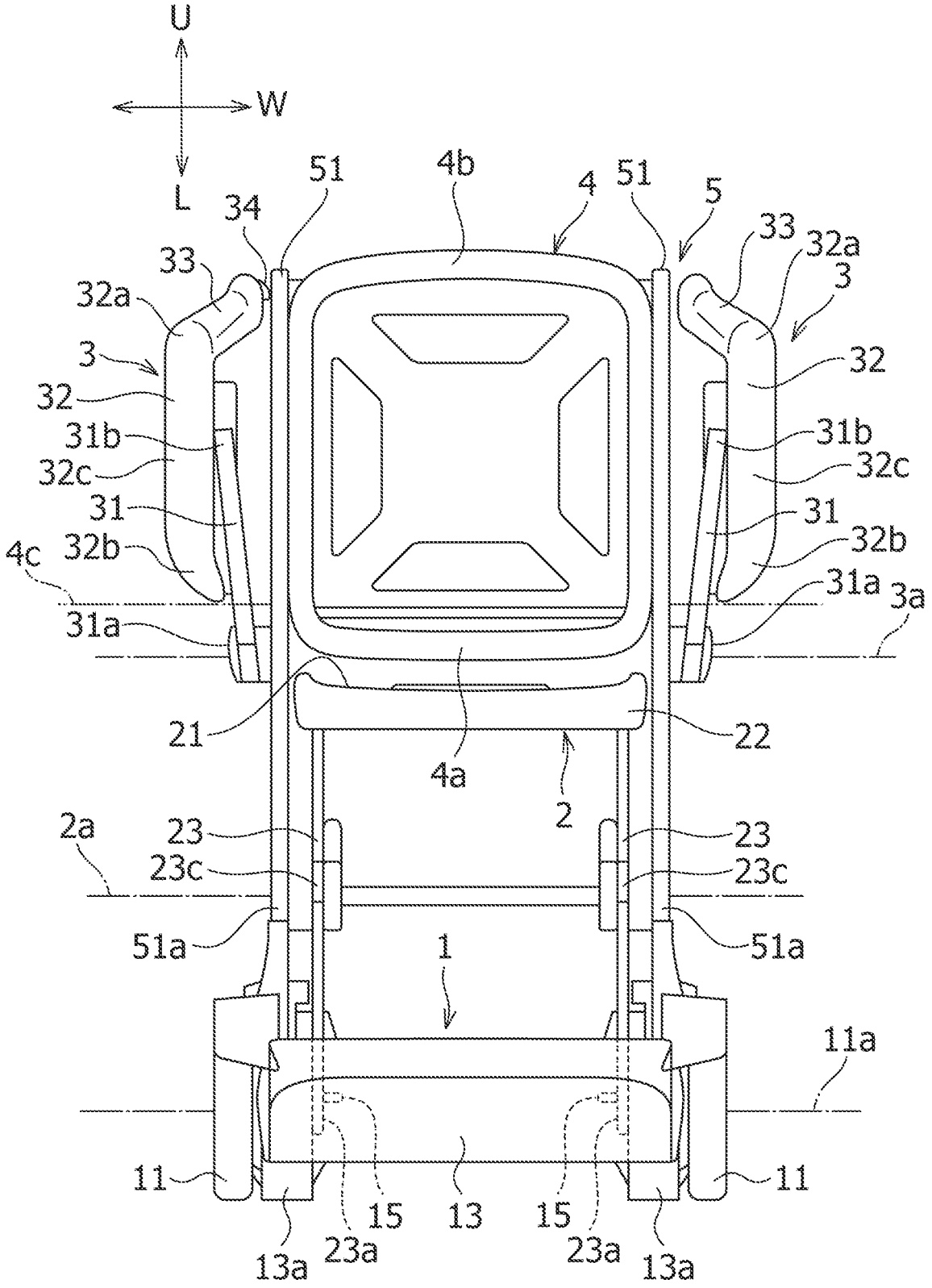
FIG. 3 is a front view schematically showing the electric vehicle according to the present Embodiment with the moving base in the expanded state, the seat in the seating position, the armrest being at a lift-up position, and the back plate at the standing-up position.
Figure 4:
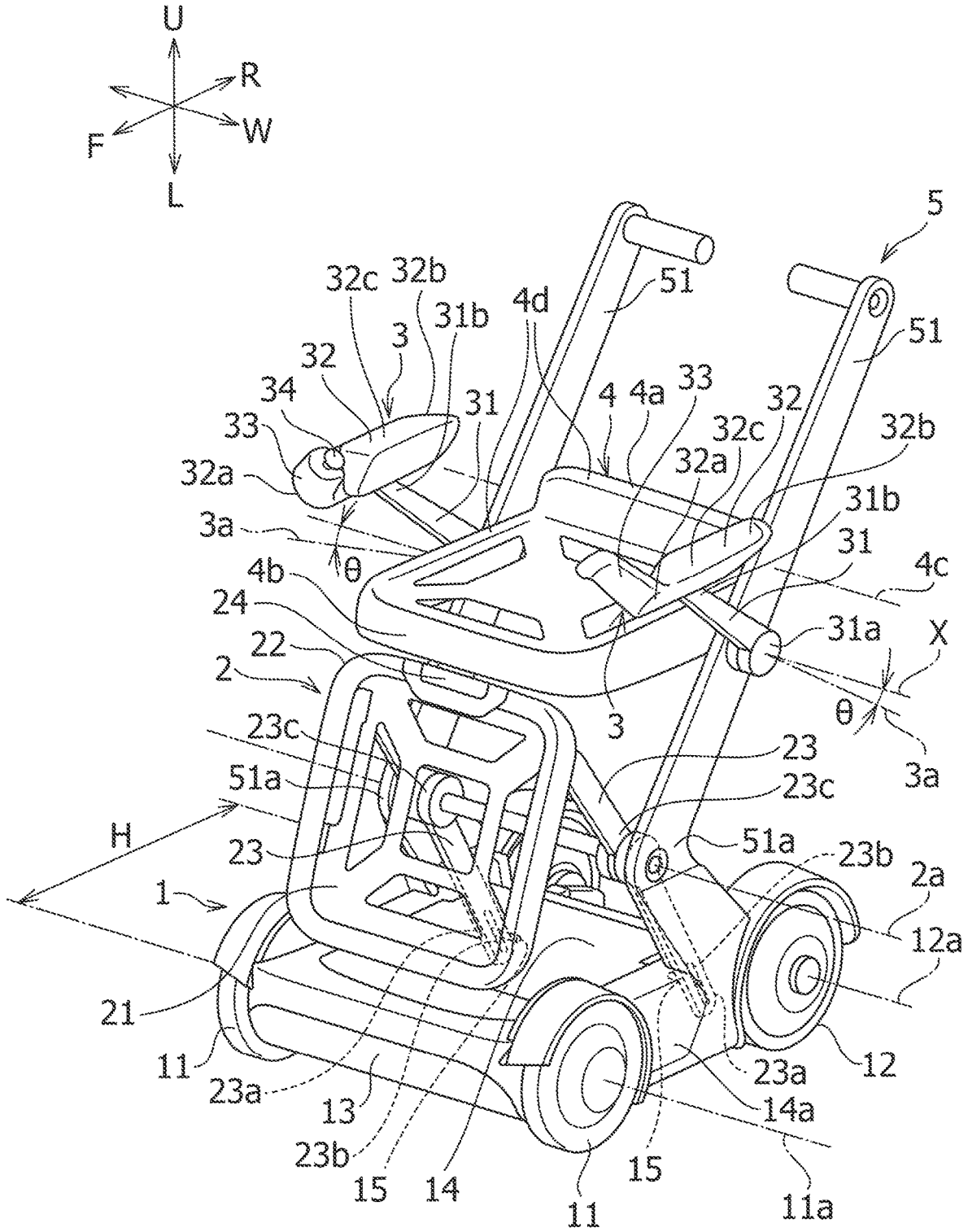
FIG. 4 is a front perspective view schematically showing an electric vehicle according to the present Embodiment with a moving base in a contracted state, a seat in a retracting position, the armrest being at the position of use, and a back plate in a lying-down position.

Note that in FIGS. 1 and 4 of the drawings used in the description of the present Embodiment, a vehicle front and a vehicle rear are indicated respectively by an arrow F and an arrow R. That is to say, the vehicle front-rear direction is indicated by the arrow F and the arrow R. In FIGS. 1 to 4, a vehicle width direction is indicated by an arrow W. In FIGS. 1 to 4, a vehicle upper side and a vehicle lower side are indicated respectively by an arrow U and an arrow L. That is to say, a vehicle upper-lower direction is indicated by the arrow U and the arrow L.

Overview of Electric Vehicle

The electric vehicle of the present Embodiment will be schematically described. As shown in FIG. 1 to FIG. 4, the vehicle includes a moving base 1 configured so as to be capable of traveling by electromotive drive. The moving base 1 includes two front wheels 11, and two rear wheels 12 which are located in the vehicle rear at a distance from the front wheels 11. The front wheels 11 and the rear wheels 12 serve as traveling wheels of the vehicle. However, the moving base may have at least one front wheel and two or more rear wheels, or may have two or more front wheels and at least one rear wheel.

The vehicle includes a seat 2 disposed on the moving base 1. The seat 2 includes a seating surface 21 configured so as to allow the user to be seated. In particular, the seat 2 may have a single-seater configuration. However, the seat of the vehicle is not limited thereto.

The vehicle includes an armrest 3 located outwards of the seating surface 21 in a width direction of the vehicle. In particular, the vehicle may have two armrests 3. The two armrests 3 may be respectively positioned on both sides of the seating surface 21 in the width direction of the vehicle. However, the vehicle may be configured so as to have at least one armrest.

The armrests 3 are disposed on the moving base 1. The armrests 3 each include a supporting part 31 supported on the moving base 1, and a body part 32 supported by the supporting part 31. The armrests 3 each include a grip 33 protruding from the body part 32.

The armrests 3 are configured so as to be changeable in position between the position of use and the lift-up position. Specifically, as shown in FIGS. 1, 2, and 4, the armrests 3 at the position of use are disposed so as to allow the user seated on the seating surface 21 to hold the grips 33 wile placing the arms above the armrests 3. As shown in FIG. 3, the armrests 3 are disposed at the lift-up position so as to lift up the grips 33 to a position upward of the position of use. Referring to FIGS. 1 to 4, the grips 33 positioned at the lift-up position are located outward of the grips 33 at the position of use in the width direction of the vehicle.

In addition, the vehicle described above may be configured as follows. As shown in FIGS. 1 to 4, the supporting part 31 of each of the armrests 3 is supported so as to be pivotable about a pivot axis 3*a* between the position of use and the lift-up position of the armrests 3. As shown in FIGS. 1 and 4, the pivot axis 3*a* is inclined from a center in a width direction of the vehicle outward in the width direction of the vehicle as it goes from the vehicle rear to the vehicle front. As shown in FIGS. 1 to 4, in a state in which the armrests 3 are in the position of use, the grips 33 protrude from the body parts 32 of the armrests 3 so as to incline from an outer side in the width direction of the vehicle toward the center of the vehicle in the width direction as it goes from the vehicle lower side toward the vehicle upper side.

The grip 33 on one of the two armrests 3 includes an operation part 34 configured so as to allow the vehicle to be operable. In particular, the operation part 34 may be configured so as to allow the user to operate with one hand. The operation part 34 may be a joystick. However, each of the grips of the two armrests may have the operation part. The operation part is not limited thereto, and may be a button, a touch-sensitive board, a lever, a dial-type knob, and/or the like.

The vehicle includes a back plate 4 configured so as to be capable of being used as a seatback corresponding to the seating surface 21 of the seat 2. The back plate 4 is also disposed on the moving base 1. The back plate 4 is configured so as to be movable between a standing-up position and a lying-down position. Specifically, as shown in FIGS. 1 to 3, the back plate 4 is positioned in the vehicle rear and the vehicle upper side with respect to the seating surface 21 in the standing-up position. As shown in FIG. 4, the back plate 4 is positioned at the vehicle front in the standing-up position in contrast to the lying-down position. The back plate 4 in the lying-down position is located at the vehicle lower side and toward the center in the width direction of the vehicle with respect to the armrests 3 in the position of use.

In addition, as shown in FIGS. 1 to 4, the vehicle includes a frame 5 located on the moving base 1 at the vehicle rear with respect to the seat 2.

Details of Moving Base

The moving base 1 may be configured in detail as follows. As shown in FIGS. 1 to 4, the moving base 1 includes a front base 13 having the front wheels 11 and a rear base 14 having the rear wheels 12. The rear base 14 is disposed at the vehicle rear with respect to the front base 13. Referring to FIGS. 1 and 4, the moving base 1 is configured so as to be changeable in such a manner that a wheel base H between the front wheels 11 and the rear wheels 12 is expanded and contracted. In other words, the front and rear bases 13 and 14 of the moving base 1 are configured so as to be movable relative to each other to allow the wheel base H to be expanded and contracted. However, the moving base may be configured so as to keep the wheel base unchanged. In other words, the moving base may be configured so as not to allow the wheel base to be expanded and contracted.

By the relative movement of the front and rear bases 13 and 14, the moving base 1 can be changed between the expanded state in which the wheel base H is expanded as shown in FIG. 1, and the contracted state in which the wheel base H is contracted so as to shorten the length of the wheel base H than the length in the expanded state as shown in FIG. 4. In addition, the moving base 1 described above, is configured so as to allow the rear wheels 12 to be driven and make the front wheels 11 stop for expanding and contracting the wheel base H. In other words, when expanding the wheel base H, the rear wheels 12 are driven to rotate to move the rear base 14 toward the vehicle rear, and the front wheels 11 are stopped to immobilize the front base 13 at a certain position. In contrast, when contracting the wheel base H, the rear wheels 12 are driven to rotate to move the rear base 14 toward the vehicle front, and the front wheels 11 are stopped to immobilize the front base 13 at a certain position.

However, the moving base may be configured in such a manner that the front wheels are driven and the rear wheels are stopped in order to expand and contract the wheel base. The moving base may be configured in such a manner that the front wheels and the rear wheels are driven to rotate in the opposite directions from each other in order to expand and contract the wheel base.

Referring to FIG. 1 and FIG. 4, the front and rear bases 13 and 14 of the moving base 1 are configured so as to be substantially linearly slidable relative to each other in the vehicle front-rear direction. In particular, the difference in length of the wheel base H between the expanded state and the contracted state of the moving base 1, may be at least a half the maximum length of the seat 2 in the seat front-rear direction and not longer than the maximum length of the seat 2. The vehicle can travel stably while stably supporting a user riding thereon when the moving base 1 is in the expanded state, and the vehicle can move in a zippy manner when the moving base 1 is in the contracted state.

As shown in FIGS. 1 to 4, the front base 13 of the moving base 1 includes two anterior side members 13*a* disposed at a distance from each other in the vehicle width direction. The two front wheels 11 are attached respectively to the two anterior side members 13*a* at front end portions in the vehicle front-rear direction so as to be rotatable about an axis of rotation 11*a* extending in the vehicle width direction.

Each of the anterior side members 13*a* is provided with a pivot shaft 15 at a rear end portion thereof in the vehicle front-rear direction so as to protrude therefrom in the vehicle width direction. As will be described in detail later, a leg part 23 of the seat 2 is attached to the pivot shaft 15. Both of the pivot shafts 15 are disposed so as to avoid interference with the rear base 14 when the front and rear bases 13 and 14 move relative to each other.

As shown in FIG. 1, the pivot shafts 15 may be positioned at front end portions of the posterior side members 14*a* in the vehicle front-rear direction when the moving base 1 is in the expanded state. The pivot shafts 15 may be positioned in the vicinity of the rear wheels 12 when the moving base 1 is in the contracted state.

In addition, the rear base 14 of the moving base 1 includes two posterior side members 14*a* disposed at a distance from each other in the vehicle width direction. The two rear wheels 12 are attached respectively to the two posterior side members 14*a* at rear end portions in the vehicle front-rear direction so as to be rotatable about an axis of rotation 12*a* extending in the vehicle width direction.

Although not particularly shown, a battery serving as a power supply source for the vehicle, and a control device for electrically controlling the vehicle, are mounted on the moving base 1. A braking device is mounted on the front base 13 of the moving base 1 so as to be capable of braking the two front wheels 11. Drive motors for driving the rear wheels 12 to rotate is mounted on the rear base 14 of the moving base 1. For example, the drive motors may be disposed to be adjacent to the respective rear wheels 12 in the vehicle width direction, or the drive motors may be built in the respective rear wheels 12. However, the drive motor is not limited thereto.

In the vehicle configured in this manner, the braking device, the control device, and the drive motors are electrically connected to the battery, respectively. The battery is capable of supplying power to the braking device, the control device, and the drive motors, respectively. The control device is connected to the braking device and the drive motors respectively. The control device is capable of controlling the braking device, the battery and the drive motors, respectively.

Details of Seat

The seat 2 may be configured in detail as follows. As shown in FIGS. 1 to 4, the seat 2 includes the seating part 22 having the seating surface 21 and two leg parts 23 capable of supporting the seating part 22. The two leg parts 23 are disposed at a distance from each other in the seat width direction. Note that the seat width direction is substantially aligned with the vehicle width direction. However, the seat may be configured so as to have at least one leg part.

The seat 2 is attached to the moving base 1 so as to be movable in accordance with expansion and contraction of the wheel base H. In the seat 2, the seating part 22 is configured so as to move forward along with the movement of the leg part 23 in association with the relative movement of the front and rear bases 13 and 14 in the vehicle front-rear direction for contracting the wheel base H. The seating part 22 is configured so as to move rearward along with the movement of the leg part 23 in association with the relative movement of the front and rear bases 13 and 14 in the vehicle front-rear direction for expanding the wheel base H.

Referring to FIGS. 1 to 4, the seat 2 is configured so as to be movable between the seating position in which the seating part 22 is positioned with the seating surface 21 facing the vehicle upper side, and the retracting position in which the seating part 22 is retracted from the seating position to the vehicle front. As shown in FIGS. 1 to 3, the seating part 22 can be disposed at the seating position when the moving base 1 is in the expanded state. The seat 2 may be disposed such that the seating surface 21 of the seating part 22 extends substantially along a vehicle horizontal direction when the seating part 22 is in the seating position.

As shown in FIG. 4, the seat 2 can be positioned in the retracting position when the moving base 1 is in the contracted state. The seat 2 may be arranged such that the seating surface 21 of the seating part 22 is directed at a predetermined angle with respect to a plane extending in the vehicle upper-lower direction and the vehicle width direction when the seating part 22 is in the retracting position. The predetermined angle may be approximately 30 degrees or less in absolute value. However, the angle of the seating surface is not limited thereto.

As shown in FIGS. 1 to 4, a front end region of the seating part 22 in the seat front-rear direction is a free end. Note that the seat front-rear direction is substantially orthogonal to the seat width direction, and is a direction extending between the front surface and the rear surface of the seating part 22. In a state in which the seat 2 is in the seating position, the front end region of the seating part 22 is located at the vehicle front with respect to a rear end region of the seating part 22 in the seat front-rear direction, and the rear end region of the seating part 22 is positioned so as to substantially be aligned with the frame 5 in the vehicle front-rear direction. In a state in which the seat 2 is in the retracting position, the rear end region of the seating part 22 is located at the vehicle upper side with respect to the front end region of the seating part 22, and is positioned at a distance to the vehicle front with respect to the frame 5.

In addition, as shown in FIG. 4, the seat 2 is also provided with a back plate supporting mechanism 24 configured so as to support the back plate 4 in a state in which the seat 2 and the back plate 4 are in the retracting position and in the lying-down position respectively. The back plate supporting mechanism 24 corresponds to the rear end region of the seating part 22 in the seat front-rear direction. However, the invention is not limited thereto.

Each of the leg parts 23 extends so as to be inclined from the rear to the front in the seat front-rear direction as it goes from the upper to the lower in the seat upper-lower direction. Each of the leg parts 23 may also extend downward in the seat upper-lower direction from a side end region of the seating part 22 in the seat width direction on a side corresponding to each of the leg parts 23.

Each of the leg parts 23 includes a base attaching region 23*a* configured so as to attach the leg part 23 to the front base 13. The base attaching region 23*a* is attached to the pivot shaft 15 of the anterior side member 13*a* so as to be pivotable. More specifically, the base attaching region 23*a* is provided with an attaching long hole 23*b* penetrating therethrough in the vehicle width direction so as to allow insertion of the pivot shaft 15 therethrough. The attaching long hole 23*b* extends along the longitudinal direction of the leg part 23. When the front base 13 moves in the vehicle front-rear direction with respect to the rear base 14, the pivot shaft 15 moves in the longitudinal direction of the attaching long hole 23*b* in the attaching long hole 23*b*.

Each of the leg parts 23 has a frame attaching region 23*c* for attaching the leg part 23 to the frame 5 so as to be pivotable with respect to the frame 5. The frame attaching region 23*c* is positioned between the seating part 22 and the base attaching regions 23*a*. The base attaching regions 23*a* of each of the leg parts 23 may be located at a lower end of the leg part 23 in the seat upper-lower direction, and the frame attaching region 23*c* of each of the leg parts 23 may be located in an intermediate region of the corresponding leg part 23 in the seat upper-lower direction.

In the seat 2 configured in this manner, the movement of the seating part 22 toward the vehicle front is achieved by the movement of the base attaching regions 23*a* of the leg parts 23 to the vehicle rear in association with the relative movement of front and rear bases 13 and 14 with each other in the vehicle front-rear direction for contracting the wheel base H and the pivotal movement of the leg parts 23 toward the vehicle front. The seating part 22 can be moved from the seating position to the retracting position by the movement thereof toward the vehicle front.

The relative movement of the front and rear bases 13 and 14 in the vehicle front-rear direction for expanding the wheel base H causes the movement of the base attaching regions 23*a* of the leg parts 23 toward the vehicle front, and the pivotal movement of the leg parts 23 toward the vehicle rear, whereby the movement of the seating part 22 toward the vehicle rear is achieved. The seat 2 can move from the retracting position to the seating position by the movement thereof toward the vehicle rear.

Details of Armrests

The armrests 3 may be configured in detail as follows. As shown in FIGS. 1 to 4, the armrests 3 may be positioned in the vehicle upper side with respect to the seating part 22. The supporting parts 31 of the two armrests 3 are attached respectively to two posts 51 of the frame 5 described later, such that the two armrests 3 are pivotable respectively about the pivot axes 3*a*.

The supporting part 31 of each of the armrests 3 may have a supporting region 31*a* to be attached so as to be pivotable to the post 51 corresponding to this armrest 3. In addition, in each of the armrests 3, the supporting part 31 may be provided at a connecting region 31*b* to be connected to the body part 32. The supporting region 31*a* and the connecting region 31*b* of the supporting part 31 are positioned at a distance from each other. The supporting region 31*a* is positioned in the vehicle lower side with respect to the connecting region 31*b*. The supporting part 31 of the armrest 3 is positioned in the vehicle upper side with respect to the base end part 4*a* of the back plate 4.

The body part 32 of each of the armrests 3 has a leading end region 32*a* and a base end region 32*b* which face each other, and an intermediate region 32*c* which extends between the leading end region 32*a* and the base end region 32*b*. The grip 33 protrudes from a leading end region 32*a* of the body part 32. When each of the armrests 3 is in the position of use, the leading end region 32*a* of the body part 32 of the armrest 3 is positioned in the vehicle front with respect to the base end region 32*b*.

When each of the armrests 3 is in the lift-up position, the leading end region 32*a* of the body part 32 of the armrest 3 is positioned in the vehicle upper side with respect to the base end region 32*b*. In particular, when each of the armrests 3 is in the lift-up position, the supporting part 31, the body part 32, or the grip 33 of the armrest 3 may be positioned so as to be substantially aligned with the back plate 4 in the standing-up position in the vehicle front-rear direction, or may be positioned in the vehicle rear with respect to the back plate 4 in the standing-up position.

The pivot axis 3*a* may pass through the supporting region 31*a* of the supporting part 31, and incline toward the vehicle front with respect to the axial line X in the width direction extending in the vehicle width direction by an angle of inclination θ. The angle of inclination θ may be the same for the two armrests 3. The angle of inclination θ may fall within a range from approximately 5 degrees to approximately 15 degrees. For example, the angle of inclination θ may be approximately 10 degrees. However, the angle of inclination is not limited thereto, and the angle of inclination of two of the armrests may be different. The angle of inclination may be set to allow a user in a state of being seated on the seating surface of the seat, to pivot the armrests between the position of use and the lift-up position.

In addition, the pivot axis 3*a* may be positioned along the horizontal plane. However, the pivot axis is not limited thereto, and the pivot axis may be inclined toward the vehicle upper side or the vehicle lower side with respect to the horizontal plane.

Details of Back Plate

The back plate 4 may be configured in detail as follows. Referring to FIGS. 1 and 4, the back plate 4 is attached to the frame 5 so as to be pivotable between the standing-up position and the lying-down position. As shown in FIG. 1, the back plate 4 is disposed along a plane extending in the vehicle width direction and the vehicle upper-lower direction in a state of being at the standing-up position. As shown in FIG. 4, the back plate 4 is disposed along the vehicle horizontal direction in a state of being at the lying-down position.

As shown in FIGS. 1 to 4, the back plate 4 is formed into a substantially flat plate shape. The back plate 4 in the standing-up position includes a base end part 4*a* and a leading end part 4*b* located on the lower end side and the upper end side, respectively, in the vehicle upper-lower direction. The base end part 4*a* of the back plate 4 may be attached to two posts 51 of the frame 5, described later, such that the back plate 4 is pivotable about the pivot axis 4*c* extending in the vehicle width direction. More specifically, the base end part 4*a* of the back plate 4 is attached to an intermediate portion of the posts 51 in the vehicle upper-lower direction. The back surface of the back plate 4 is a plane extending in the horizontal direction in a state in which the back plate 4 is in the lying-down position, and in a state in which the back plate 4 is in the lying-down position, a baggage, such as a shopping basket, luggage, and/or the like may be placed on the back surface. Part or the entire part of a peripheral edge portion of the back plate 4 is provided with a baggage stop 4*d* protruding with respect to the back surface. In particular, the baggage stop 4*d* may be provided on part of the peripheral edge portion of the back plate 4 including one or both of the base end part 4*a* and the leading end part 4*b* of the back plate 4, or may be provided over the entire part of the peripheral edge portion of the back plate 4. The baggage stop 4*d* may be composed of a plurality of elements apart from each other in the circumferential direction of the back plate 4, or may be formed integrally so as to continue in the circumferential direction of the back plate 4.

The leading end part 4*b* of the back plate 4 is a free end. The leading end part 4*b* of the back plate 4 configured as described above, is pivotable about the pivot axis 4*c* between the standing-up position and the lying-down position. In addition, as shown in FIG. 4, in a state in which the seat 2 is in the retracting position and the back plate 4 is in the lying-down position, the leading end part 4*b* of the back plate 4 is supported by the back plate supporting mechanism 24 of the leg parts 23 of the seat 2.

Details of Frame

The frame 5 may be configured in detail as follows. As shown in FIGS. 1 to 4, the frame 5 is disposed so as to be adjacent to the seat 2 in the seating position in the vehicle rear. The frame 5 has two posts 51 disposed at a distance from each other in the vehicle width direction. The two posts 51 are disposed so as to correspond to the posterior side members 14*a* of the rear base 14 respectively in the vehicle width direction. The two posts 51 are disposed so as to respectively correspond to the two leg parts 23 of the seat 2 in the vehicle width direction.

A lower end portion of each of the posts 51 in the vehicle upper-lower direction is attached to a rear end portion of the posterior side members 14*a* corresponding to this post 51 in the vehicle front-rear direction. Each of the posts 51 includes a seat pivoting attaching part 51*a* configured so as to be capable of attaching the frame attaching region 23*c* of the leg part 23 of the seat 2, which corresponds to this post 51. The frame attaching region 23*c*, configured in this manner, is attached to a seat pivoting attaching part 51*a* so as to be pivotable about the pivot axis 2*a* extending in the vehicle width direction.

The seat pivoting attaching part 51*a* is disposed between a front end and a rear end of the rear base 14 in the vehicle front-rear direction. In particular, as shown in FIGS. 1 to 3, the seat pivoting attaching part 51*a* may be disposed in a lower region in the vehicle upper-lower direction of each of the posts 51 located in the vehicle lower side with respect to the seating part 22 of the seat 2 in the seating position. The lower region of the post 51 may be formed in a bent shape so as to protrude toward the vehicle front in substantially a triangle shape. In this case, the seat pivoting attaching part 51*a* may be positioned at an apex of the lower region protruding in the substantially triangle shape toward the vehicle front.

Unfolded State and Folded State of Electric Vehicle

The unfolded state and the contracted state of the electric vehicle will be described. As shown in FIG. 1, the vehicle assumes an unfolded state when the moving base 1 is in the expanded state and the seat 2 is in the seating position. When the vehicle is in the unfolded state, the vehicle is capable of traveling by operating an operation part 34 with a user in a riding state. When the vehicle is in the unfolded state, the vehicle is capable of traveling by pushing the vehicle with the user, an assistant, and/or the like positioned in the vehicle rear. The vehicle in the unfolded state can be used as a wheelchair, a cart, and/or the like.

As shown in FIG. 4, the vehicle assumes the folded state when the moving base 1 is in the contracted state and the seat 2 is at the retracting position. The vehicle in the folded state is also capable of traveling by pushing the vehicle with the user positioned in the vehicle rear. The vehicle in the folded state can be used as a walking assisting vehicle, a shopping cart, a wheeled platform, and/or the like.

As described thus far, the electric vehicle according to the present Embodiment includes: the moving base 1, the seat 2, and the armrests 3 as described above. The armrests 3 each include the supporting part 31 supported on the moving base 1, and the body part 32 supported by the supporting part 31. The armrests 3 each further include a grip 33 protruding from the body part 32. The armrests 3 each are configured so as to be changeable between the position of use in which the armrest 3 is disposed to allow a user seated on the seating surface 21 to hold the grip 33 with the arm positioned in the vehicle upper side with respect to the armrests 3, and the lift-up position in which the grip 33 is positioned so as to be lifted up to the vehicle upper side with respect to the position of use. The grip 33 in the lift-up position is located outward of the vehicle in the width direction with respect to the grip 33 in the position of use.

According to the electric vehicle configured in this manner, the grips 33 protruding from body parts 32 of the armrests 3 are positioned forward of the user seated on the seat 2 in a state in which the armrests 3 are in the position of use. Therefore, the user can be seated stably while holding the grips 33. In other words, the sense of stability in seating for a user, can be improved. In addition, the grips 33 of the armrests 3 in the lift-up position are located outward of the vehicle in the width direction with respect to the grips 33 of the armrests 3 in the position of use. Therefore, when the user is seated on the seat 2, in particular, when the user is about to dismount the electric vehicle, the armrests 3 are prevented from becoming an obstacle for the user. In addition, the width of the vehicle with the armrests 3 positioned in the position of use, can be reduced, so that reduction in size of the vehicle can be achieved. Consequently, the convenience of the vehicle can be improved.

In the electric vehicle according to the present Embodiment, the supporting part 31 of the armrest 3 is supported such that the armrest 3 is pivotable about the pivot axis 3*a* between the position of use and the lift-up position, and the pivot axis 3*a* is inclined from the vehicle rear toward the vehicle front as it goes from the center of the vehicle width direction outward of the vehicle width direction. In the electric vehicle in this configuration, when the user is seated on the seat 2, in particular, when the user is about to dismount the vehicle, the armrests 3 can be moved gradually outward in the vehicle width direction while moving from the position of use to the lift-up position. Therefore, when the user is seated on the seat 2, in particular, when the user is about to dismount the vehicle, the armrests 3 are prevented from becoming an obstacle for the user efficiently. The width of the vehicle with the armrests 3 positioned in the position of use can be reduced efficiently, so that reduction in size of the vehicle can be efficiently achieved. Consequently, the convenience of the vehicle can be efficiently improved.

In the electric vehicle according to the present Embodiment, in a state in which the armrests 3 are in the position of use, the grips 33 protrude from the body part 32 of the armrests 3 so as to incline from an outer side in the width direction of the vehicle toward a center of the vehicle in the width direction as it goes from the vehicle lower side toward the vehicle upper side. In the electric vehicle configured in this manner, the user can be seated stably while holding the grips 33 as described above. In other words, the sense of stability in seating for the user can be improved efficiently. In addition, when the armrests 3 are provided on both sides in the width direction of the seat 2 after the user has gotten off the vehicle, baggage such as a shopping basket, luggage, and/or the like can be placed on the seat 2 between the both armrests 3, so that the baggage can be stably supported by the grips 33. Therefore, the convenience of the vehicle can be improved.

The electric vehicle according to the present Embodiment, the grip 33 includes the operation part 34 which is configured to be capable of operating the vehicle. In the electric vehicle configured in this manner, the operation part 34 can be integrated in the grip 33. Therefore, the reduction in size of the vehicle can be achieved. In addition, the operation part 34 disposed on the grip 33 is easy to operate for the user. Therefore, the convenience of the vehicle can be improved.

The electric vehicle according to the present Embodiment includes the back plate 4 as described above. The back plate 4 is configured so as to be movable between the seating standing-up position in which the back plate 4 is positioned in the vehicle rear and the vehicle upper side with respect to the seating surface 21, and the lying-down position in which the back plate 4 is positioned in the vehicle front with respect to the standing-up position. The back plate 4 in the lying-down position is located at the vehicle lower side and toward the center in the width direction of the vehicle with respect to the armrests 3 in the position of use. In the electric vehicle in this configuration, when the armrests 3 are provided on both sides in the width direction of the back plate 4 in the lying-down position, baggage such as a shopping basket, luggage, and/or the like can be placed on the back plate 4 between the both armrests 3, so that the baggage can be stably supported by the grips 33. Therefore, the convenience of the vehicle can be improved.

While the Embodiment of the invention has been described thus far, the invention is not limited to the Embodiment described above, and the invention may be modified and altered based on the technical concept of the invention.

What is claimed is:

1. A mobile object comprising:

a moving base including a front wheel and a rear wheel positioned at a distance from each other in a front-rear direction of the mobile object;

a seat having a seating surface and disposed on the moving base; and an armrest located outward of the seating surface in a width direction of the mobile object, wherein the armrest includes a supporting part supported on the moving base, and a body part supported by the supporting part, the armrest further includes a grip protruding from the body part, the armrest is configured so as to be changeable between a position of use in which the armrest is disposed to allow a user seated on the seating surface to hold the grip with an arm of the user positioned above the armrest, and a lift-up position in which the grip is positioned so as to be lifted up to a position upward of the position of use, the grip in the lift-up position is located outward of the mobile object in the width direction with respect to the grip in the position of use, the supporting part is supported so as to be pivotable about a pivot axis between the position of use and the lift-up position, and the pivot axis is inclined from rearward to forward of the mobile object as going outward from a center in the width direction of the mobile object, and positioned along the horizontal plane.

2. The mobile object according to claim 1, wherein in a state in which the armrest is in the position of use, the grip protrudes from a body part of the armrest so as to be inclined from outside toward a center in the width direction of the mobile object as going from downward to upward.

3. The mobile object according to claim 1, wherein the grip includes an operation part configured so as to be capable of operating the mobile object.

4. The mobile object according to claim 1, further comprising a back plate configured so as to be used as a seatback corresponding to the seating surface, the back plate disposed on the moving base, wherein the back plate is configured so as to be movable between a standing-up position in which the back plate is positioned in the rear and the upper of the mobile object with respect to the seating surface, and a lying-down position in which the back plate is positioned in the front of the mobile object with respect to the standing-up position, and the back plate in the lying-down position is located downward and toward the center in the width direction of the mobile object with respect to the armrest in the position of use.

* * * * *